United States Patent [19]

Thomson et al.

[11] 3,945,316

[45] Mar. 23, 1976

[54] PORTABLE TRANSACTION-LOG RECORDER

[75] Inventors: Morton W. Thomson, Castro Valley; Mitchel A. Trout, Albany, both of Calif.

[73] Assignee: Dymo Industries, Inc., San Franciso, Calif.

[22] Filed: Jan. 17, 1974

[21] Appl. No.: 434,209

[52] U.S. Cl. ..... 101/45; 101/272; 101/407 BP

[51] Int. Cl.[2] ..... B41F 3/04

[58] Field of Search... 101/45, 56, 407 BP, 269–274

[56] References Cited

UNITED STATES PATENTS

| | | | |
|---|---|---|---|
| 2,982,205 | 5/1961 | Maul | 101/269 |
| 3,280,739 | 10/1966 | Hu | 101/45 X |
| 3,358,596 | 12/1967 | Davis | 101/269 |
| 3,608,485 | 9/1971 | Schulze | 101/269 |
| 3,709,144 | 1/1973 | Sims | 101/269 X |
| 3,762,316 | 10/1973 | Spradlin | 101/45 |
| 3,776,130 | 12/1973 | Tamiya | 101/56 X |
| 3,824,922 | 7/1974 | Van Acker | 101/45 |

*Primary Examiner*—Edgar S. Burr
*Assistant Examiner*—Edward M. Coven
*Attorney, Agent, or Firm*—Harris Zimmerman

[57] ABSTRACT

An improved apparatus for the recording of credit card transactions at point of sale, and for reporting said transactions to a central accounting and processing activity. The instant invention includes a self contained, compact, portable and lightweight cassette-like transaction log recorder which is adapted to be releasably and operatively engageable with an imprinter mechanism. The recorder contains both an external duplicate sales ticket and an internal continuous form log sheet for the sequential recording of individual transactions at the time various data is applied to successive sales tickets. The recorder is also provided with external receiving means for receiving the customer's credit card at a receiving station, means for translating the card from the receiving station to an imprinting station, means for latching the card immovably at the imprinting station to an external removing station. The recorder is further provided with a safety interlock system which prevents the human error of recording two discrete transactions on the same portion of the log sheet. This interlock system includes means for effectively disabling the card latching means until the log sheet is deliberately incrementally advanced, thereby displacing the record of the previous transaction from the imprint station and presenting an unused portion of the log sheet for recording of the next sequential transaction. Unless the card latching means is operative, no imprinting can occur.

15 Claims, 20 Drawing Figures

FIG _ 16
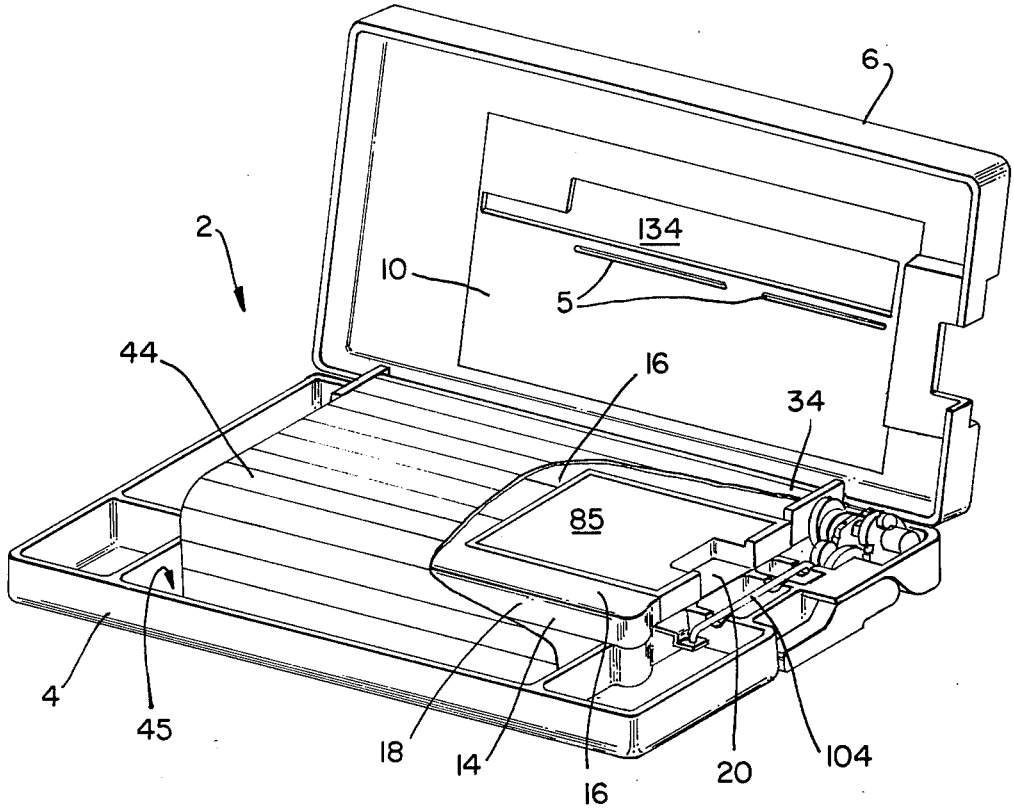
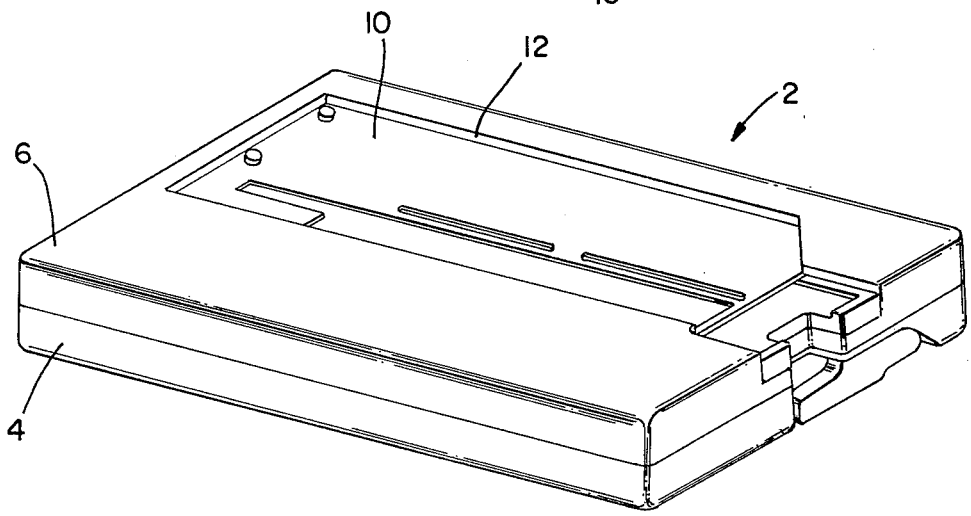
FIG _ 17

FIG _ 18
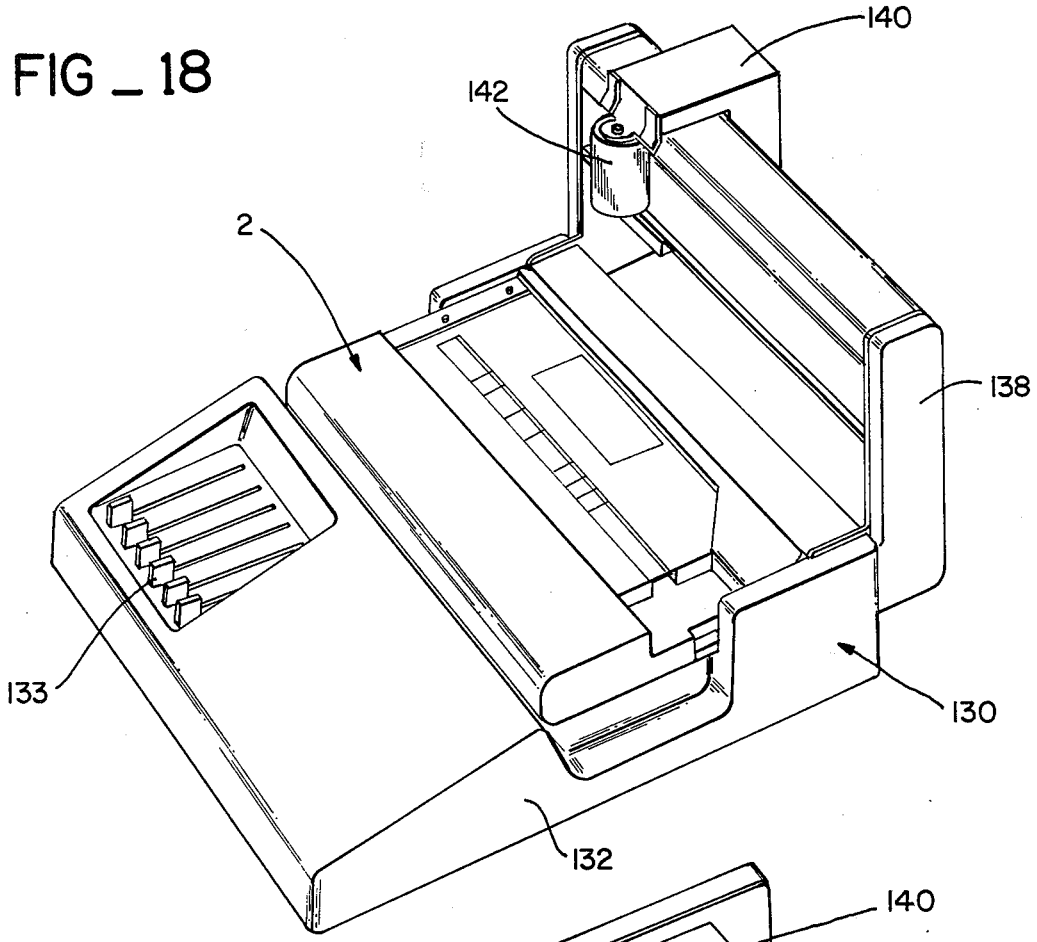
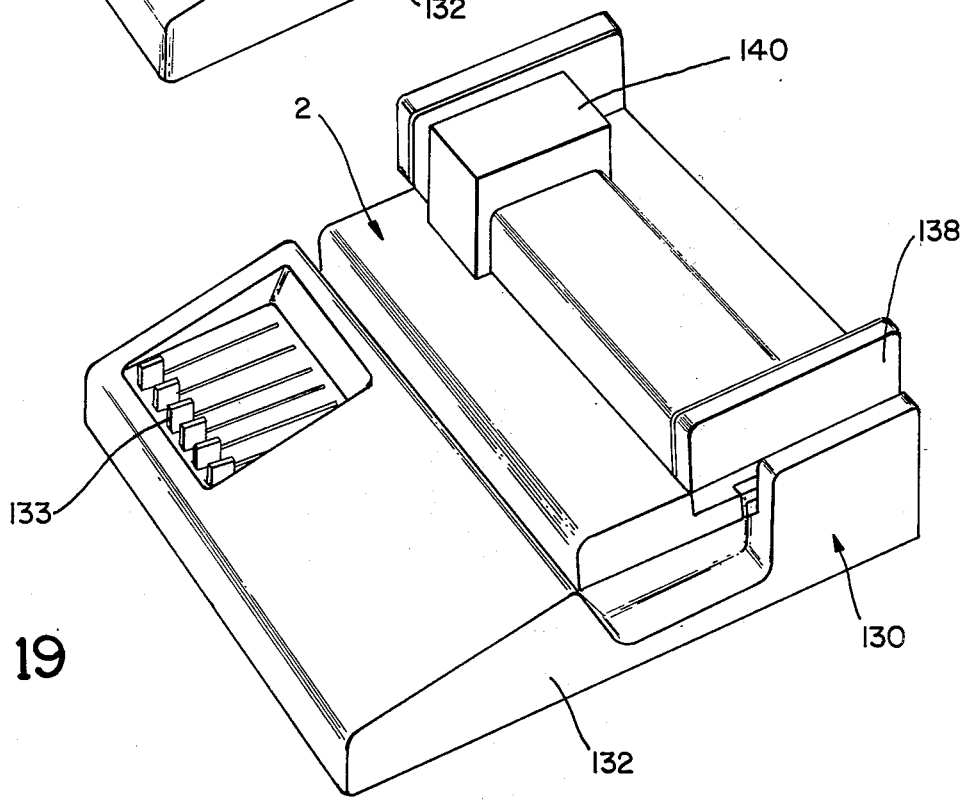
FIG _ 19

PORTABLE TRANSACTION-LOG RECORDER

BACKGROUND OF THE INVENTION

This invention generally relates to an improved apparatus and method for the recording of credit card transactions at point of sale, and for facilitating the reporting of such transactions to a central accounting or other processing activity.

Using the automotive service station industry as an example, commonly used practices call for a customer's purchase to be manually recorded by an attendant on a perforated triplicate copy sales ticket interspersed with two carbon leaves. Variable information, such as the monetary amount of sale, are recorded manually on the ticket with pen or pencil, and then imprinted thereon by an imprinting apparatus in a quality susceptible of optical character recognition equipment processing. Constant information, such as dealer name and code, and customer name and credit card account number, are respectively obtained from a fixed plate secured to the imprinting apparatus and from the customer's credit card when the latter is inserted into the imprinting apparatus.

Once the imprinting is completed, the multicopy sales ticket is usually presented to the customer on a clipboard, for authorizing signature. After signature, the attendant separates the perforated triplicate copies. The top, original copy is presented to the customer when his credit card is returned to him. The bottom, second copy is retained by the attendant for station records. The middle, third copy is retained by the attendant for an arbitrary time, such as one business day, and then transmitted with other similarly accumulated copies to a central accounting activity for subsequent billing of the customer's account and crediting of the station's account.

Considerable difficulties are encountered by the central accounting activity in batch processing the accumulated third copies. For example, such copies do not always arrive in chronological sequence, necessitating hand sorting by date of transaction. Individual copies are sometimes lost, resulting in expensive reconcilement efforts. And, most important, the sheer physical bulk and weight in handling of individual transaction copies results in significant handling, postage or other expense.

To overcome those problems, the instant invention concentrates the transmittal document information by providing a single sheet, continuous form transaction log sheet which carries certain significant information for each transaction such as date, amount of sale, credit card number and signature on a single line of the log sheet. The transactions are listed chronologically, and each transaction may be assigned a printed sequential transaction number. Finally, the invention reduces the physical number of transmittal documents that must be accumulated and mailed to and processed by the central accounting activity, thereby reducing probability of loss and handling expense.

SUMMARY OF THE INVENTION

The instant invention generally comprises a self contained, portable, cassette like transaction log recorder for use with a relative stationary imprinter mechanism. The recorder contains both an external duplicate sales ticket and an internal continuous form log sheet for the sequential recording of individual transactions at the time the sales ticket is completed. The recorder is lightweight, so as to be capable of being handled with one hand, and of minimal exterior dimension to permit its passage through an automobile window for customer signature.

The apparatus of this invention is provided with external receiving means for receiving the customer's credit card at a receiving station, means for translating the card from the receiving station to an imprinting station, means for latching the card immovably at the card from the imprinting station to an external removing station. The recorder is further provided with a safety interlock system which prevents the human error of recording two discrete transactions on the same line or portion of the log sheet. This interlock system includes means for effectively disabling the card latching means until the log sheet is deliberately incrementally advanced, thereby displacing the record of the previous transaction from the imprint station and presenting an unused portion or the next line of log sheet for recording of the next sequential transaction. When the card latching means is inoperative or disabled, no imprinting can take place.

DETAILED DESCRIPTION OF THE DRAWINGS

FIG. 16 is a perspective view of the transaction log recorder of the instant invention with the top cover lid open, and the credit card tray in the imprinting position.

FIG. 17 is a perspective view of the recorder with the top cover closed, and the credit card tray in position for receiving or removal of the credit card.

FIG. 18 is a perspective view of an imprinter mechanism with the recorder in place and the upper imprinter frame raised.

FIG. 19 is a view similar to FIG. 18, but with the upper frame lowered into the imprint position.

DESCRIPTION OF THE PREFERRED EMBODIMENT

Figure 2:
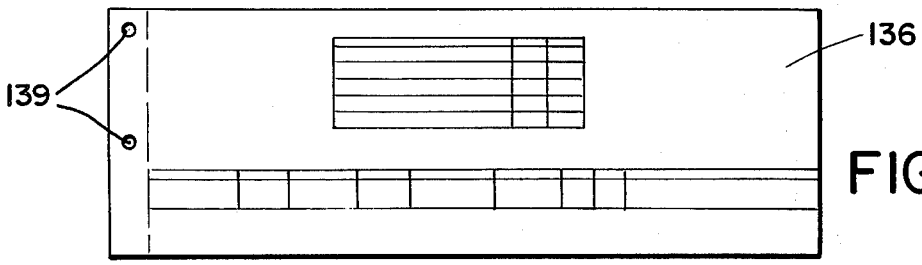
FIG. 2 is a top plan view of a form of sales ticket which may be used in conjunction with the instant invention.
Figure 3:
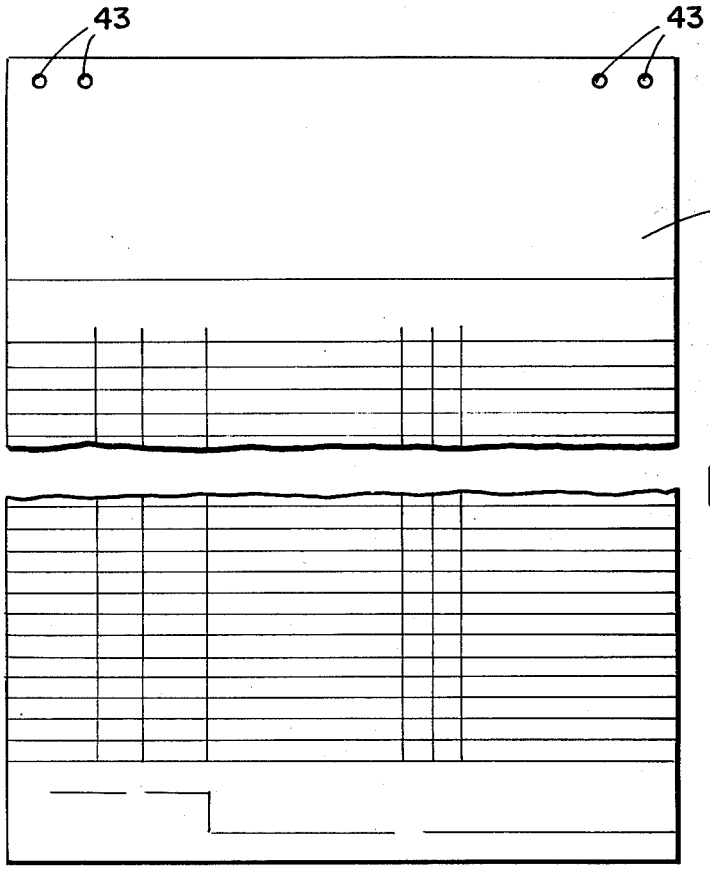
FIG. 3 is a top plan view of a form of transaction log sheet which may be used in conjunction with the instant invention.

Before describing the details of the apparatus, reference may first be made to one example of a sales ticket and a log sheet which may be used with the apparatus. A sales ticket 136 which may be used in conjunction with the instant invention is seen in FIG. 2 and comprises, for example, a duplicate two-sheet form both bound and having locating perforations 139 at their left edges. Said sheets may be either of impact-imaging paper, or a translucent paper imaging from a separate double faced carbon leaf between said sheets. Thus, upon imprinting as is hereinafter discussed, transaction identification information is simultaneously transferred to the top customer's copy by carbon impression on the back side of the copy, and to the lower service station's copy by carbon impression of the front side of the copy. The reverse side of the service station's copy may also be provided with a carbon backing to simultaneously transfer all or any of the imprinted information to a generally continuous transaction log sheet 44, seen in FIGS. 3 and 16 when the latter is positioned below the sales ticket. By selective sizing of said carbon backing, various items of information can be prevented from imprinting on the transaction log sheet, as desired.

Figure 1:
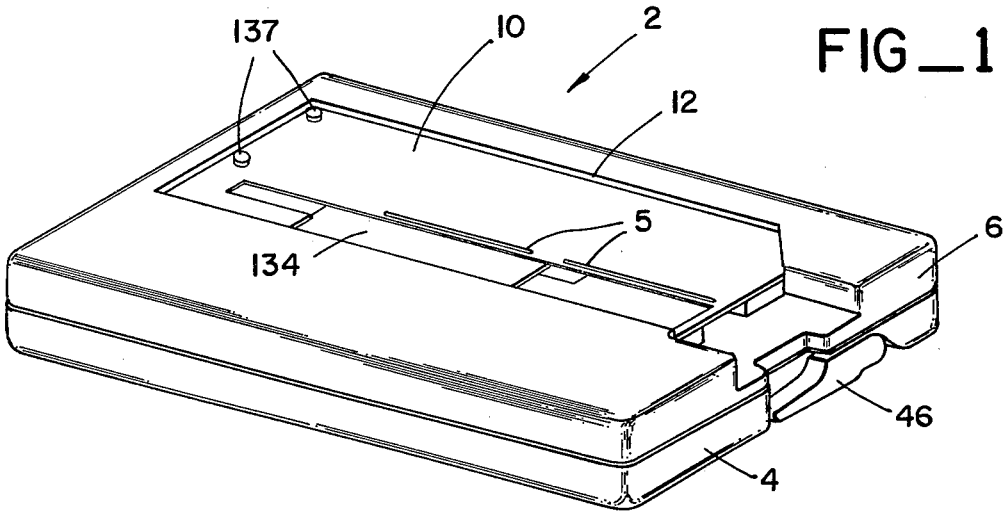
FIG. 1 is a perspective view of the transaction log recorder apparatus of the instant invention, with a credit card receiving tray in the card imprinting position.
Figure 4:
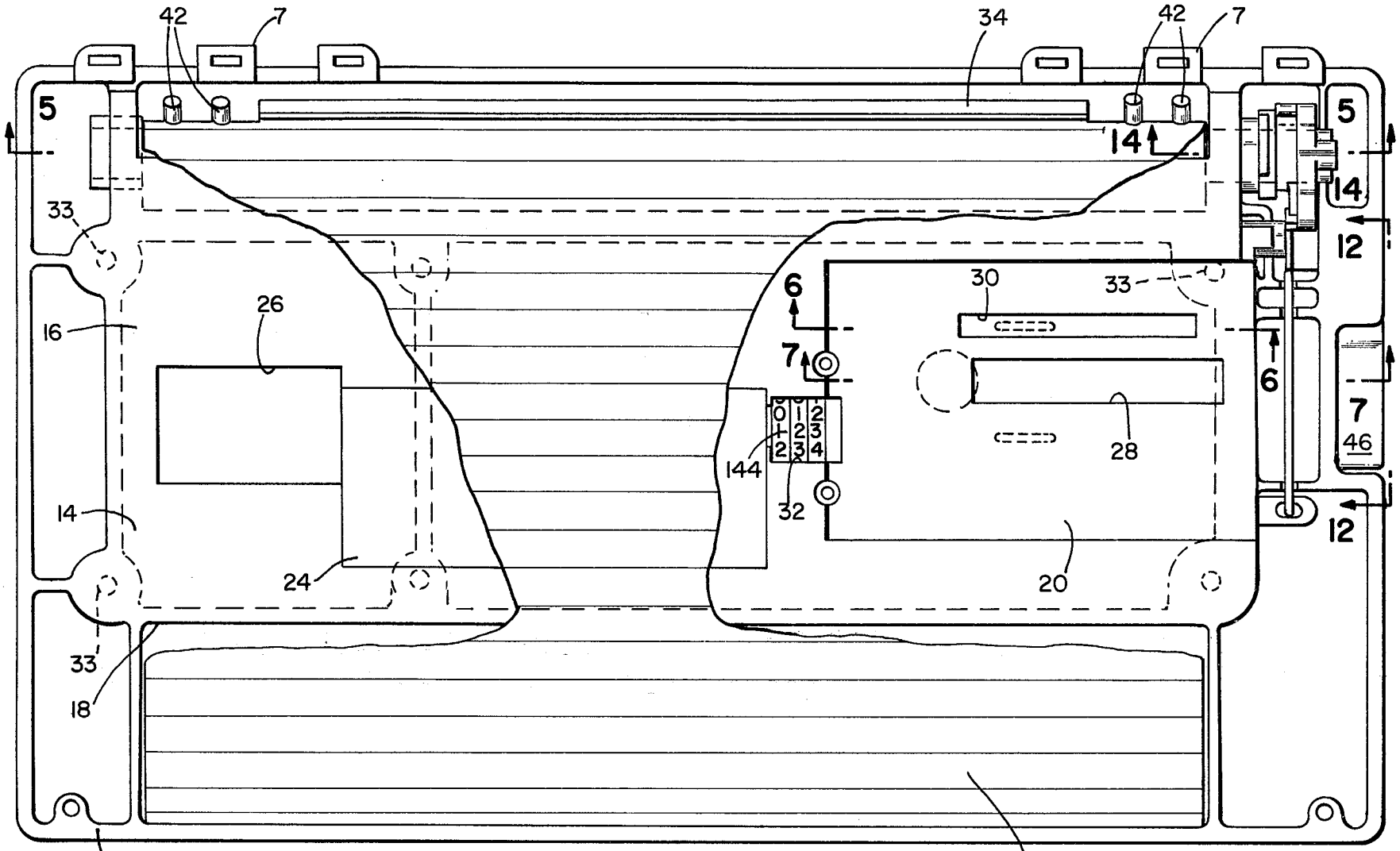
FIG. 4 is a top plan view of the anvil member of the recorder apparatus, with a log sheet take-up roller in place.

Referring to FIGS. 1, 16 and 17, the transaction log recorder 2 of the instant invention comprises a lower rigid shell 4, and a complementary upper cover lid 6 hinged to said shell along only one edge thereof by hinges 7 seen in FIG. 4. A generally rectangular aperture is provided in the top surface of lid 6 wherein is secured a planar mask 10 slightly recessed from said top surface to form a slight ledge 12 in said lid 6. Mask 10 is provided with a central imprinting aperture 134, and two transaction obliteration apertures 5. When in the closed orientation, as shown in FIGS. 1 and 17, the lid 6 may be releasably secured to lower shell 4 by means of standard bayonet and slot fasteners or the like, not shown.

Figures 5, 6, 7, 8, 9, 10, 11:
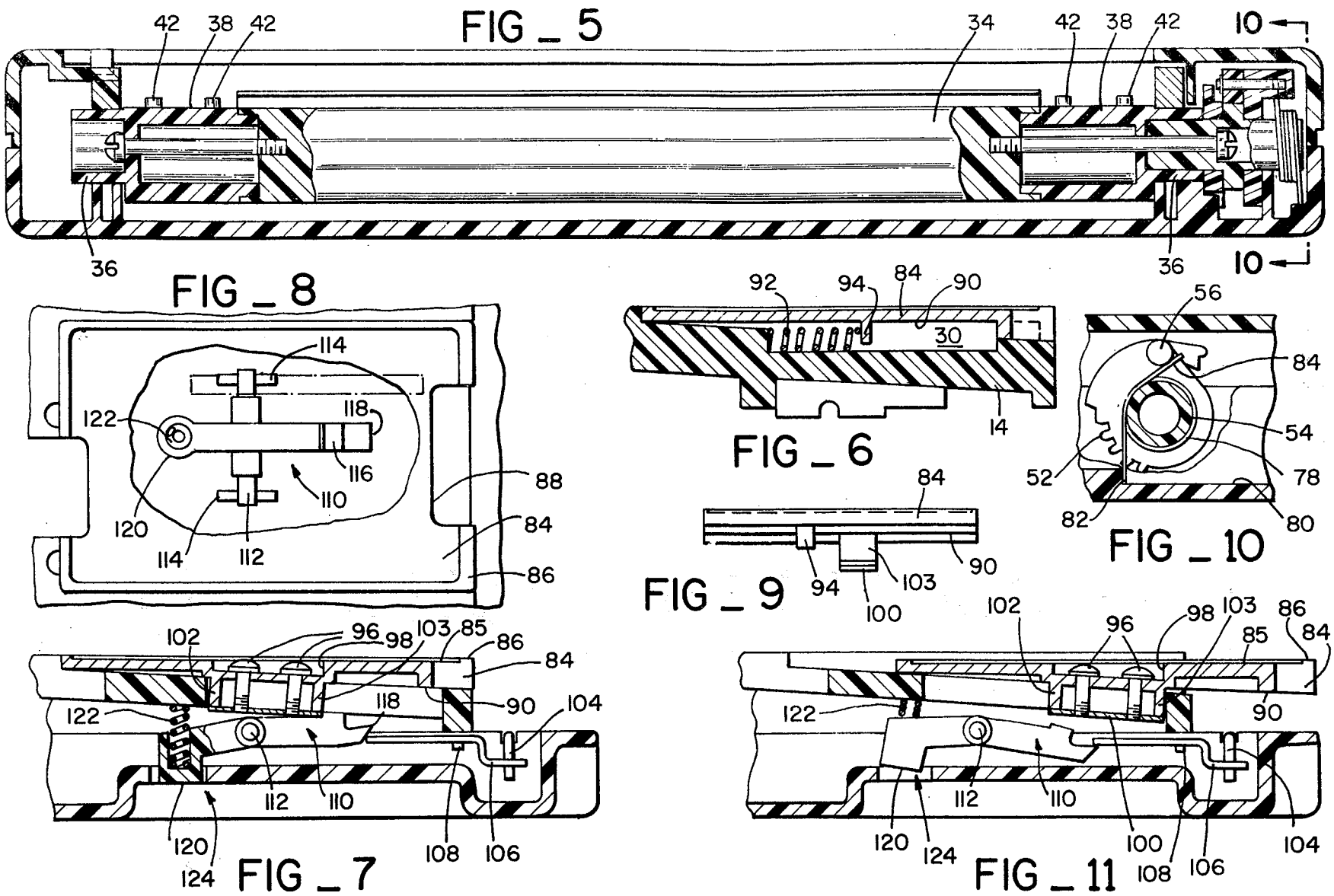
FIG. 5 is a front cross-sectional view of the take-up roller taken on line 5—5 of FIG. 4.
FIG. 6 is a front cross-sectional view of the credit card receiving tray taken on line 6—6 of FIG. 4.
FIG. 7 is a front cross-sectional view of a portion of the interlock mechanism of the instant invention, with the credit card receiving tray latched in its operative imprinting position, taken on line 7—7 of FIG. 4.
FIG. 8 is a top plan view of a portion of the structure shown in FIG. 7.
FIG. 9 is an end view of the credit card receiving tray.
FIG. 10 is an end cross-sectional view of a driven sector gear and return spring comprising a portion of the log sheet advance mechanism, and taken on line 10—10 of FIG. 5.
FIG. 11 is a side view similar to FIG. 7, but with the credit card receiving tray unlatched and in position for removal of the credit card.

Also disposed within the lower shell 4 is a rigid anvil 14, best seen in FIGS. 4, 8 and 16, with a generally planar top writing surface 16, a rounded frontal edge 18, a recessed planar, inclined ramp surface 20, a recessed horizontal surface 24, a left side aperture 26, a track slot 28, a spring-retaining groove 30, and a central aperture 32. The writing surface 16 forms a desk top for customer signature of the sales ticket. The rounded edge 18 forms a guide for the transaction log sheet 44 as it advances across the anvil, while the ramp surface 20 forms a guide for a credit card holding tray hereinafter described. The horizontal surface of the anvil also defines and forms a location pad wherein is secured the service station's fixed printing plate, listing constant information such as dealer name, address and identification-code number.

Anvil 14 is secured to the lower shell 4 by a plurality of machine screws threaded in tapped bosses 33. Also rotatably secured to the underside of anvil 14 is a bank of tandem sequential transaction number imprinter wheels 144. Upper portions of said wheels extend upwardly through the central aperture 32 in anvil 14 to contact the lower surface of log sheet 44. Vertically extending from the top surface of mask 10 are two cylindrical locating pins 137 upon which the locating perforations 139 in ticket 136 center when the ticket is placed into position directly above mask 10 in the recess formed by ledge 12. When in this position, aperture 134 in the mask is directly below a portion of said ticket, and permits imprinting contact by said service station plate, the sequential transaction imprinter wheels 144, the customer's credit card, and other additional imprinting wheels desired so as to imprint transaction data and variable monetary amount of the sale.

Figure 20:
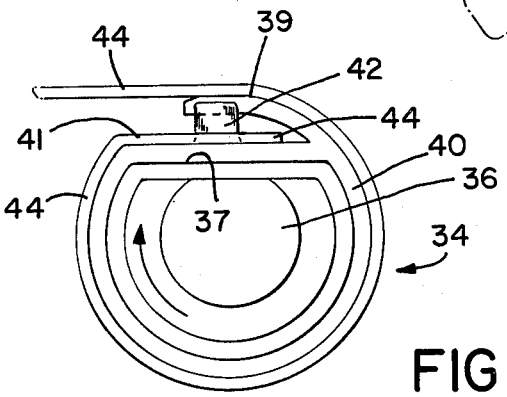
FIG. 20 is an end view of the take-up roller of the instant invention.

Also disposed within lower shell 4 is a log sheet take-up roller 34, whose detail is best seen in FIGS. 4, 5 and 20. Referring to FIG. 20, the roller may be seen to comprise a central bearing shaft extension 36 longitudinally extending from a member 38 having a flat surface 37. Generally enveloping the member 38 along a central length thereof is a generally right-circular cylindrical sleeve 40. The sleeve 40 is recessed into the member 38 along the annular circumference thereof, so that the sleeve has a diameter equal to the major diameter of said member 38. A linear portion 41 of said sleeve runs parallel to said flat surface 37 of the chordal member, and an annular portion 39 of the sleeve overhangs said linear portion and is spaced therefrom. Radially extending from the chordal member 38 at the distal extremities of said sleeve are a plurality of locating pins 42 upon which corresponding perforations 43 in the upper edge of the sheet of transaction log paper may be located. As is seen in FIG. 16, the body of the log paper is laid flat, planar, and generally above and tangent to the top writing surface 16 of anvil 14, and the remainder of said sheet is curled in a reversed roll and disposed in a cavity 45 formed in lower shell 4. Thus it may be appreciated that, when said log paper is so located, and the chordal member 38 is rotated clockwise in the direction of the arrow in FIG. 20, the paper will wrap itself in a spiral of concentric circles whose radii will vary only by the paper thickness of the log sheet. Accordingly, constant angular advancement of roller 34 will incrementally advance said log sheet a generally constant linear amount equal to the interlineal transaction spacing shown in FIGS. 3 and 16. And, in the instant invention, the distance between the locating perforations 43 and the first transaction line is fixed so that, when an unused log sheet is initially affixed to said roller and the take-up roller advancement lever, hereinafter described, is cycled, the first transaction line will be appropriately indexed at the imprinting station immediately subjacent aperture 134 in mask 10.

Referring to FIGS. 1, 4, 12, 16 and 17, operatively connected to said take-up roller 34 is a roller advancement lever 46 disposed outside lower shell 4 in a complementary recess in said shell. The lever is connected to the roller by a gear train assembly best seen in FIGS. 4, 5, 10, 12, 13, 14 and 15.

Figure 13:
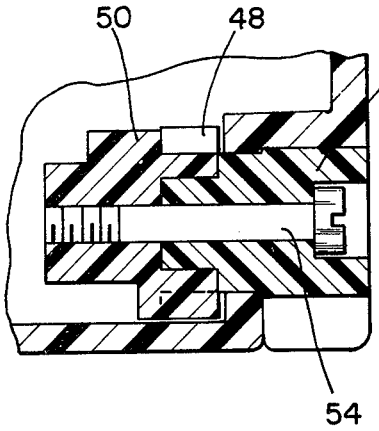
FIG. 13 is a front cross-sectional taken on line 13—13 of FIG. 12.
Figure 14:
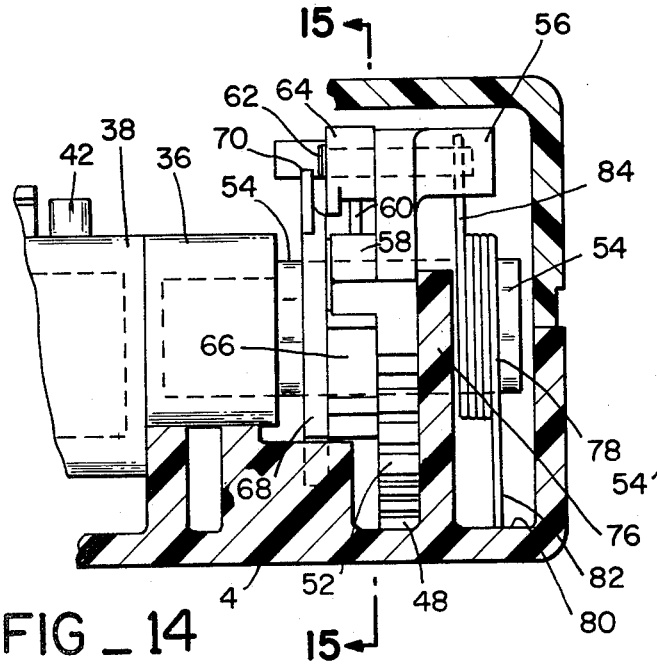
FIG. 14 is a front cross-sectional view of the roller gear train assembly of the instant invention, taken on line 14—14 of FIG. 4.
Figure 15:
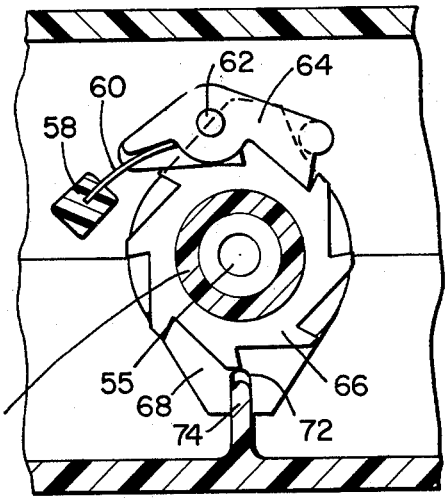
FIG. 15 is a cross-sectional view taken on line 15—15 of FIG. 14.

As shown in FIGS. 2 and 13, lever 46 is keyed by a threaded pin 54 to a sector pinion gear 48 having a tandem cam lobe 50 in fixed angular relationship therewith. As shown in FIGS. 10 and 14, pinion 48 is meshed with a complementary driven sector gear 52 which is rotatably fitted about the circumference of a cylindrical barrel 54. Said barrel is coaxial with the bearing shaft extension 36 and secured thereto by a set pin 55, as best seen in FIG. 15. Extending from one lateral surface of said gear is a cylindrical spring pad 56. Extending from the other lateral surface of said gear is a cubic anchor lug 58 from which extends a cantilevered leaf spring 60. Also extending from said other lateral surface is a pivot pin 62 about which is rotatably fastened an advancement pawl 64. As seen in FIGS. 14 and 15, the pawl is spring biased by the leaf spring 60 to engage a ratchet wheel 66 which is secured to and rotates with the barrel 54.

When assembled as in FIG. 14, the barrel 54 is supported at its one extremity near bearing shaft extension 36 by a perforated stanchion 68. Said stanchion has a cam surface 70 at its upper extremity, and a notch 72 at its lower extremity, said notch receiving and locating upon a rib 74 formed into the lower shell 4. The barrel is supported near its other extremity by a bearing rib 76, also formed in the lower shell 4. As seen in FIG. 14, a terminal portion of barrel 54 extends beyond rib 76. As best seen in FIG. 10, a helical torsion return spring 78 is fitted about the outer circumference of the barrel immediately adjacent said rib. The lower extremity 82 of said spring is held immovably against an inner wall 80 of lower shell 4, while the upper extremity of said spring contacts the cylindrical spring pad 56 on sector gear 52. Thus, said spring biases sector gear 52 in the counterclockwise direction, as viewed in FIG. 10.

Referring to FIGS. 4, 6, 7, 9 and 11, the credit card receiving and holding tray 84 is a generally rectangular receptable with a horizontal planar top surface 85 having a peripheral lip edge 86 for laterally containing a credit card, and a cutaway notch 88 for ease of insertion and removal of the card while holding same between the thumb and index finger. As best seen in FIG. 6, the tray is spring-biased by a compression spring 92 which is laterally restrained by the walls of aforementioned spring-retaining groove 30 in anvil 14, and which exerts axial force against a spring pad 94 which depends from the lower surface 90 of the tray. As is best seen in FIGS. 7 and 11, tray 84 is of wedge-shaped cross section, the lower surface 90 thereof slidingly cooperating with the aforementioned recessed planar inclined-ramp surface 20 in anvil 14. The tray is guided in the track slot 28 in anvil 14 by two parallel guide protrusions, 102 and 103 respectively, which depend from lower surface 90 in the tray's upper surface 85, and depend completely through the track slot between the guide protrusions and engage a keeper member 100. Said keeper member spans between said two guide protrusions in cantilever fashion, as best seen in FIGS. 9 and 11. Thus, it may be appreciated that, as said tray 84 is moved against spring bias from the card receiving and removal position, illustrated in FIGS. 7 and 16, said tray and a card supported thereon will remain in a horizontal attitude.

The transaction log recorder 2 of the instant invention is intended for cooperative use with a relatively stationary imprinter mechanism 130 seen in FIGS. 18 and 19. Said imprinter mechanism comprises a stationary lower frame member 132, with a plurality of slidable transaction amount keys 133 mounted therein. Said keys are operatively connected to a corresponding number of conventional imprint wheels, not shown, which are rotatably carried by the frame member. Thus, when the transaction amount is set by keys 133, the corresponding amount will be presented by said wheels in an upwardly facing attitude. Chordal portions of such wheels are adapted to extend through the left side aperture 26 of anvil 14 to contact the lower surface of log sheet 44 for imprinting action thereupon.

The imprinter mechanism 130 also includes an upper frame member 138 pivotably secured to said lower frame member. Slidably secured to said upper frame member is a slidable grip 140 from which is suspended a right circular cylindrical imprinting roller 142 which translates in unison with said grip. The central cylindrical axis of said roller is, of course, generally normal to the direction of translation of said grip along said upper frame member. Upper frame member 138 is shown in a raised inoperative orientation in FIG. 18, as when the transaction log recorder 2 is to be inserted into or removed from the lower frame member 132. Upper frame member 138 is shown in the operative imprint orientation in FIG. 19, as when the transaction log recorder is in place within the lower frame member 132 and awaiting an imprinting stroke by the grip 140.

Also contained within lower frame member 132 is a mechanism, now shown, which operatively cooperates with the sequential transaction imprinter wheels 144. When the grip 140 is translated through a complete imprint stroke, this mechanism increments the sequence count by a single digit, thereby imprinting each line on the transaction log sheet with a discrete sequential transaction number.

Interlock System

Figure 12:
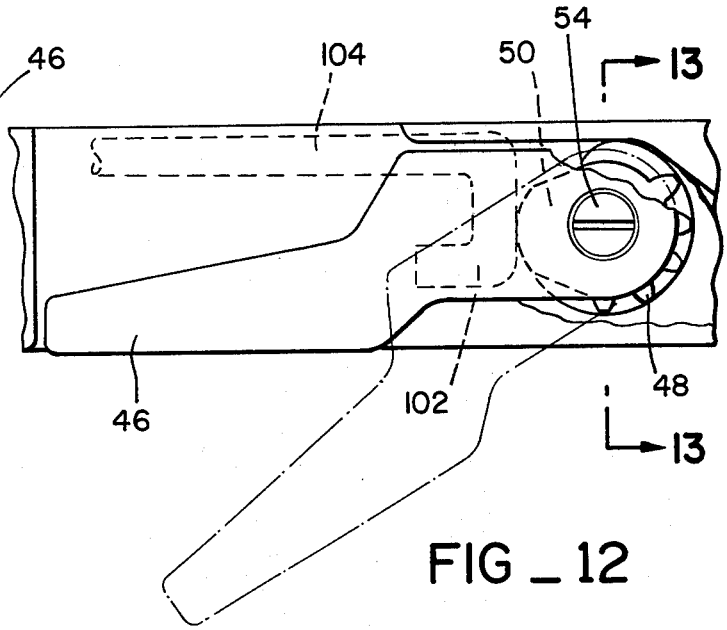
FIG. 12 is an end view of a portion of the log sheet and roller advancement mechanism taken on line 12—12 of FIG. 4.

Referring to FIGS. 12 and 16, the cam lobe 50 on section pinion gear 48 moves in unison with take-up roller advancement lever 46. Said cam is so angularly positioned with respect to the lever that, when the lever is manually angularly rotated from the generally horizontal position shown in FIGS. 1, 12, 16 and 17, to the phantom line position shown in FIG. 12, said cam lobe is rotated to extend in a generally horizontal attitude as also shown in FIG. 12. As the cam is rotated to this attitude, it laterally displaces a spring biased cam follower 101 which comprises a terminal portion of a laterally extending connecting rod 104. As is best seen in FIGS. 7, 11 and 16, the other extremity of the connecting rod is secured in an anchoring perforation in a pivotable latch plate 106. The latch plate is itself pivotably secured to a lower surface of anvil 14 by a pivot pin 108, and is further spring biased by a compression spring, not shown, to oppose the action of said cam against the follower and connecting rod. It is this spring bias which provides the aforementioned spring bias of the cam follower against the cam lobe.

Also comprising part of the interlock mechanism is a pivotable latch member 110 shown in FIGS. 7, 8 and 11. The latch member has a bearing shaft 112 which pivotably cooperates with bearing bosses 114 integrally formed in a lower surface of anvil 14. At one distal extremity of the latch member is formed a rectangular upper step 116 and a bevelled lower step 118. At the other distal extremity of said latch member is formed a pushactuated button 120 which is spring biased generally vertically downwardly by a compression spring 122.

When the customer's credit card has been inserted in the tray 84 and it is desired to move said tray and said card into the imprinting position, the aforediscussed interlock system becomes active. In its normal position between imprint cycles, the latch plate 106 and latch member 110 are disposed as shown in FIG. 11 and perform no latch action. Thus when the tray and card are manually pushed into the imprint position, the bias of spring 92 against pad 94 forces said tray back to the credit card receiving-removal position. That is, the tray cannot be latched into the imprint position until the lever 46 is advanced through its full cycle to advance the transaction log sheet by one line increment. This safety interlock feature prevents the possibility of the inadvertent imprinting of two discrete transactions on the same single line of the log sheet.

To latch tray 84 in the imprint position, the advancement lever must be manually advanced through its full cycle. This measurement causes the cam lobe 50 to displace connecting rod 104 which, in turn, pivotally rotates latch plate 106 to the position shown in FIG. 7. With the latch plate in this position, the bevelled lower step 118 of latch member 110 will respond to the bias of spring 122 and pivot generally upwardly past the edge latch plate 50, to the position also shown in FIG. 7. At this juncture, the tray 84 is manually moved from the card insert-removal position shown in FIG. 11 to the imprint position shown in FIG. 7. Thus it may be appreciated that the guide protrusion 103 will, as the tray is so moved, ride over and abut against rectangular upper step 116 of latch member 110, as shown in FIG. 7, thereby effectively latching said tray in the imprint position for imprinting operations. When said imprinting operations have been completed, the tray and card may be returned to the external receiving-removal position by mere fingertip depression of push button 120 which protrudes through aperture 124 in lower shell 4. When said button is so depressed, the rectangular upper step 116 of latch member 110 is removed from the path of guide protrusion 103, thereby permitting the tray and card to return to the external insert-remove position under the bias of spring 92.

OPERATION OF THE PREFERRED EMBODIMENT

Referring to the aforediscussed structure of the present invention, operation of the instant embodiment is as follows:

At the beginning of a business period, such as the start of each business day, the attendant will set a date imprint wheel to that day's date. An unused transaction log sheet 44 is inserted into the recorder and located upon pins 42 on the take up roller. The recorder cover lid is closed and secured to the recorder lower shell. The roller advancement lever is advanced and returned through one or more complex cycles to index the first transaction line of the fog sheet to the imprint position.

When a sales transaction is to be recorded, an unused duplicate sales ticket 136 is inserted atop mask 10 on the recorder and located upon pins 137. The customer's credit card is inserted in tray 84 at the receiving position, and said tray and card are moved together to the imprint position above the anvil so that the raised or embossed characters on the card extend upwardly to contact the lower surface of sheet 44. Since the take up roller has already been advanced to the next available transaction line, the safety interlock system will permit and said tray to latch fixedly in place in said imprint position.

The recorder is now physically placed on the imprinter mechanism, and the transaction value amount is set on the keys 133 which, in turn, set the imprinter wheels to the corresponding amount. The imprinter upper frame member is then pivoted downwardly to positon the imprinting roller immediately above mask 10. The grip 140 and roller 142 are then slidably translated through the imprinting cycle, thereby imprinting both the duplicate sales ticket and the transaction log sheet with the desired variable and constant information, the mask 10 preventing the roller from smudging the log sheet. After said imprinting cycle, the upper frame member 138 is automatically pivoted to the raised orientation, by means not shown, or manually raised to the position shown in FIG. 18 for removal of the recorder.

The recorder 2 is now removed from the imprinter and handed to the customer through his automobile window aperture for signature on the sales ticket. When so signed by the customer, a facsimile carbon signature is produced on the log sheet 44. The attendant, holding the recorder in one hand, now manually pushes push button 120 to release the card and tray from the latched imprint position to the card removal position. The card is then removed from the recorder and returned to the customer, along with the top original copy of the sales ticket. The attendant retains the second duplicate copy of the sales ticket for his records. The log sheet, containing the transaction details in sequential line order, with one transaction per line, is retained in the recorder for recording of future transactions of the business period. At the end of the business period, or when the log sheet is full, sheet 44 is removed and mailed to the central accounting activity for billing of the listed customers and crediting of the dealer's account. Depending upon the requirements of the central accounting activity, the sequential transaction wheels may be reset when a log sheet is changed; at the end of business period; or not at all to sequence transactions over multiple business periods.

We claim:

1. A portable transaction log recorder apparatus for use with an embossed credit card for applying data simultaneously both to a sales ticket and to a segment of a continuous form log sheet, comprising: an outer housing including a card receiving station and a card imprinting station;

credit card tray means slidably secured in said housing for sequentially receiving a credit card at said card receiving station, transferring and retaining said credit card at said imprinting station, and returning said card to said receiving station;

means in said housing adapted to support a continuous form log sheet;

means operatively connected to said sheet support means and adapted for indexing a segment of said log sheet incrementally past said imprinting station and including interlock means for enabling retaining said credit card at said imprinting station only after actuation of said indexing means;

means on said housing adapted for receiving and supporting a sales ticket at said imprinting station in overlying relation to said log sheet supporting means; and at least one imprinter wheel contained within said housing at said imprinting station.

2. The apparatus of claim 1 further including an anvil comprising a central structural member of said apparatus, said anvil having at least one planar writing surface, said log sheet overlying and being supported on said anvil means.

3. The apparatus of claim 1 wherein said means for indexing said log sheet comprises a generally cylindrical roller rotatably secured within said housing, said roller having means thereon adapted for releasable connection to said log sheet and a pivotable advancement lever operatively connected to said roller and disposed outside said housing for incrementally rotating said roller means and advancing a log sheet carried thereby.

4. The apparatus of claim 3 wherein said roller comprises a member having a chordal cross section and at least one generally planar surface, a central bearing shaft longitudinally extending from said chordal member, a partially cylindrical sleeve generally enveloping said chordal member along the central length thereof, said sleeve being received into said chordal member along the annular circumference thereof, said sleeve having a diameter equal to the major diameter of said chordal member, and a planar portion of said sleeve extending parallel to said planar surface of said chordal member and an annular portion of said sleeve overhanging said planar portion and being spaced therefrom.

5. The apparatus of claim 4 wherein said log sheet connection means on said roller comprises at least one locating pin radially extending from said chordal member at a location adjacent a distal extremity of said sleeve, said pin being adapted to engage an aperture in a log sheet.

6. The apparatus of claim 1 wherein said means for receiving said sales ticket comprises an externally opening recess in said housing means, and at least one locating pin normally extending from said recess and adapted to engage an aperture in a sales ticket.

7. The apparatus of claim 1, wherein said interlock means comprises a pivotable latch member spring biased to a detent position to retain said credit card tray means at said imprinting station, and a latch plate pivotably secured in said housing to engage and retain said latch member out of said detent position, further including connecting means extending between said latch plate and said indexing means for pivoting said latch plate out of said retaining engagement of said latch member upon actuation of said indexing means.

8. The apparatus of claim 7 wherein said credit card tray means comprises a slidable tray with a protrusion depending therefrom.

9. The apparatus of claim 8, wherein said latch member in said detent position engages said protrusion to retain said slidable tray at said imprinting station.

10. The apparatus of claim 9 wherein said latch member has a bevelled lower step, and a rectangular upper step including means engageable with said protrusion to retain said slidable tray at said imprinting station; and said lower step including means engageable with said latch plate to retain said latch member with said upper step out of engagement with said protrusion.

11. The apparatus of claim 10 wherein said lower step and said upper step are formed at a first distal extremity of said latch member, a manually actuable push button is formed at a second distal extremity of said latch member, and wherein said latch member is pivotable from a first position at which said button is contained within said housing to said detent position at which said button extends through an opening in said housing, said button releasing said latch member for moving said credit card tray means to said first position.

12. The apparatus of claim 7 wherein said interlock means includes a connecting rod extending from said indexing means and joined to said latch plate, and including a cam operable by said indexing means, said connecting rod including a cam follower at one extremity thereof for effecting translation of said connecting rod and actuation of said latch plate.

13. The apparatus of claim 12 wherein said latch plate has a perforation therein, the other extremity of said connecting rod being adapted for engagement with said perforation.

14. The apparatus of claim 1 further including a mask means having an aperture therein and adapted to be disposed generally between a log sheet and a sales ticket at said imprinting station.

15. The apparatus of claim 1 wherein said credit card tray means comprises a tray having a wedge-shaped cross section, and further including an anvil comprising a central structural member of said apparatus, said anvil having at least one planar writing surface and a recessed planar inclined ramp surface, a lower surface of said tray slidably engaging said ramp surface, said ramp surface being complementary to said lower surface of said tray to maintain said tray in a horizontal attitude at any position of said slidable engagement.

* * * * *